US008061782B2

(12) United States Patent
Hall et al.

(10) Patent No.: US 8,061,782 B2
(45) Date of Patent: Nov. 22, 2011

(54) SENSORS ON A DEGRADATION MACHINE

(76) Inventors: David R. Hall, Provo, UT (US); David Wahlquist, Spanish Fork, UT (US); Scott Dahlgren, Alpine, UT (US); Thomas Morris, Spanish Fork, UT (US)

( * ) Notice: Subject to any disclaimer, the term of this patent is extended or adjusted under 35 U.S.C. 154(b) by 222 days.

(21) Appl. No.: 12/209,293

(22) Filed: Sep. 12, 2008

(65) Prior Publication Data

US 2010/0065290 A1 Mar. 18, 2010

(51) Int. Cl.
*E01C 23/07* (2006.01)

(52) U.S. Cl. ..... 299/1.5; 299/1.1

(58) Field of Classification Search ..... 299/1.05, 299/1.1, 1.2, 1.5
See application file for complete search history.

(56) References Cited

U.S. PATENT DOCUMENTS 4,507,612 A * 3/1985 Payne ..... 324/329
4,929,121 A * 5/1990 Lent et al. ..... 404/84.05
4,968,098 A * 11/1990 Hirsch et al. ..... 299/1.1
5,378,081 A 1/1995 Swisher, Jr.
5,983,165 A 11/1999 Minnich
6,062,650 A * 5/2000 Smith et al. ..... 299/1.4
6,109,111 A 8/2000 Heimbruch
6,532,190 B2 3/2003 Bachrach
7,179,018 B2 * 2/2007 Hall et al. ..... 404/90
2005/0175412 A1 * 8/2005 Lloyd ..... 404/77
2006/0198703 A1 * 9/2006 Hall et al. ..... 404/94

* cited by examiner

*Primary Examiner* — John Kreck
(74) *Attorney, Agent, or Firm* — Tyson Wilde; Philip W. Townsend, III

(57) ABSTRACT

In one aspect of the invention, a machine for degrading a natural and/or man-made formation has picks connected to a drum of the machine and at least one accelerometer mounted to the machine adapted to measure forces acting on the machine. Electronic equipment is in communication with the at least one accelerometer and the electronic equipment has a processor adapted to determine a change in the formation based off of input from the at least one accelerometer. The electronic equipment also is in communication with a mechanism adapted to control, at least in part, a location of the drum.

18 Claims, 15 Drawing Sheets

SENSORS ON A DEGRADATION MACHINE

BACKGROUND OF THE INVENTION

Formation degradation, such as pavement milling, mining, or excavating, may result in wear on attack tools. Consequently, many efforts have been made to extend the life of these tools.

U.S. Pat. No. 5,378,081 to Swisher, Jr., which is herein incorporated by reference for all that it contains discloses a milling machine having a rotary cutter drum which is movable both horizontally and vertically into operating position. The milling machine includes a mobile frame, a cutter rack, a cutter housing, a cutter drum and a pair of cutter skids. The cutter rack is mounted for vertical sliding movement to the front end of the frame. A pair of hydraulic cylinders are provided between the frame and the cutter rack to move the cutter rack to an operating elevation. In turn, the cutter housing is mounted for horizontal sliding movement to the cutter rack. A hydraulic cylinder is provided to move the cutter housing to bear on a surface being milled and to support the cutter housing and cutter during the milling operation. Two hydraulic cylinders are provided on each side of the cutter housing to move the cutter housing vertically to set the cutter drum to a cutting depth. The rotary cutter drum is transversely mounted within the cutter housing with a portion of the cutter drum protruding from the bottom of the cutter housing. The frame is supported on front and rear wheels by legs which telescope under electro-hydraulic control to adjust the elevation of the frame.

U.S. Pat. No. 6,532,190 to Bachrach, which is herein incorporated by reference for all that it contains, discloses a preferred embodiment of a seismic sensor array which includes a sheet of material and seismic sensors mounted to the sheet. In a further aspect of the present invention, the array includes devices to make the seismic sensor array portable and transportable. In another aspect of the present invention, the seismic sensor array is part of a seismic measurement recording system which includes a data collection box and a computer.

U.S. Pat. No. 5,983,165 to Minnich et al., which is herein incorporated by reference for all it contains, discloses a concrete paving system of a variety employing an array of vibrators which consolidate dispersed concrete over a roadbed or the like as the concrete is introduced to the mouth of a slipform pan or mold. The rate of vibration of these vibrators is monitored utilizing an accelerometer in conjunction with a vibration conversion network treating the acceleration signals to deriving vibration rate data which is published for each vibrator at a display. A controller with the system provides for the development of upper limit and lower threshold alarm limits which may be displayed along with audible warnings. Such vibration transducer based monitoring system also may be used for rotational component performance monitoring as well as in conjunction with probes located within distributed concrete in the vicinity of the array of consolidation vibrators to evaluate the performance of the latter. The monitoring system also is employable with the vibratory components of the dowel bar insertion assemblies.

U.S. Pat. No. 6,109,111 to Heimbruch et al., which is herein incorporated by reference for all that it contains, discloses a concrete finishing machine having a plurality of vibrators to be at least partially submerged in concrete or other semi-fluid viscous material for vibration thereof, a monitor is provided for displaying and/or recording operational parameters of the plurality of vibrators. The monitor includes a display, responsive to signals generated by sensors operatively associated with the plurality of vibrators, for providing a visual indication of operating parameters for the plurality of vibrators, and a recording device receiving the signals generated by sensors operatively associated with the plurality of vibrators and recording the operating parameters for the plurality of vibrators.

BRIEF SUMMARY OF THE INVENTION

In one aspect of the invention, a machine for degrading a natural and/or man-made formation has picks connected to a drum of the machine and at least one accelerometer mounted to the machine adapted to measure forces acting on the machine in a direction substantially vertical to a direction of travel of the machine. Electronic equipment is in communication with the at least one accelerometer and the electronic equipment has a processor adapted to determine a change in the formation based off of input from the at least one accelerometer. The electronic equipment also is in communication with a mechanism adapted to control, at least in part, a location of the drum.

The mechanism may have a hydraulic piston associated with a translation assembly of the machine. The mechanism may have a lift assembly adapted to control the elevation of the drum with respect to an underside of the machine. The lift assembly may have hydraulic pistons, mechanical jacks or combinations thereof. The mechanism may be in communication with a power train assembly of the machine. The mechanism may be in communication with a drum driver assembly adapted to alter a rotational speed of the drum.

The at least one accelerometer may communicate wirelessly with the electronic equipment. The at least one accelerometer may detect acceleration on three axes. The at least one accelerometer may measure acceleration from 0 G to 10 G. The at least one accelerometer may have a resolution of 0.001 G. The electronic equipment may be in communication with a fuel consumption sensor adapted to measure the real time fuel consumption of the machine during operation. The electronic equipment may be in communication with a metal detector attached to a front end of the machine. A detection range of the metal detector may be controlled by a variable voltage source.

The machine may be a road milling machine. The machine may be a mining machine. The machine may have a vertically aligned rotary element comprising an array of super hard cutters adapted to rotate about a vertical central axis. The at least one accelerometer may be attached to the drum. The at least one accelerometer may be attached to a box shield adapted to partially enclose the drum and proximate a bearing housing for the drum.

In another aspect of the invention, a method for reducing wear on a machine for degrading a natural and/or man-made formation has the following steps: providing picks connected to a drum of the machine and at least one accelerometer mounted to the machine; providing electronic equipment in communication with the at least one accelerometer; the equipment being adapted to interpret feedback from the accelerometer and adapted to send a signal; and altering an operation of the machine in response to the at least one signal sent by the electronic equipment.

In another aspect of the invention, a machine for degrading a natural and/or man-made formation has picks connected to a drum of the machine and at least one sensor mounted to the machine adapted to measure adverse conditions on the machine. Electronic equipment is in communication with the at least one sensor, the electronic equipment being adapted to determine a change in the formation from feedback from the at least one sensor. The electronic equipment also is adapted to execute an emergency response based off the feedback.

DETAILED DESCRIPTION OF THE INVENTION AND THE PREFERRED EMBODIMENT

Figure 1:
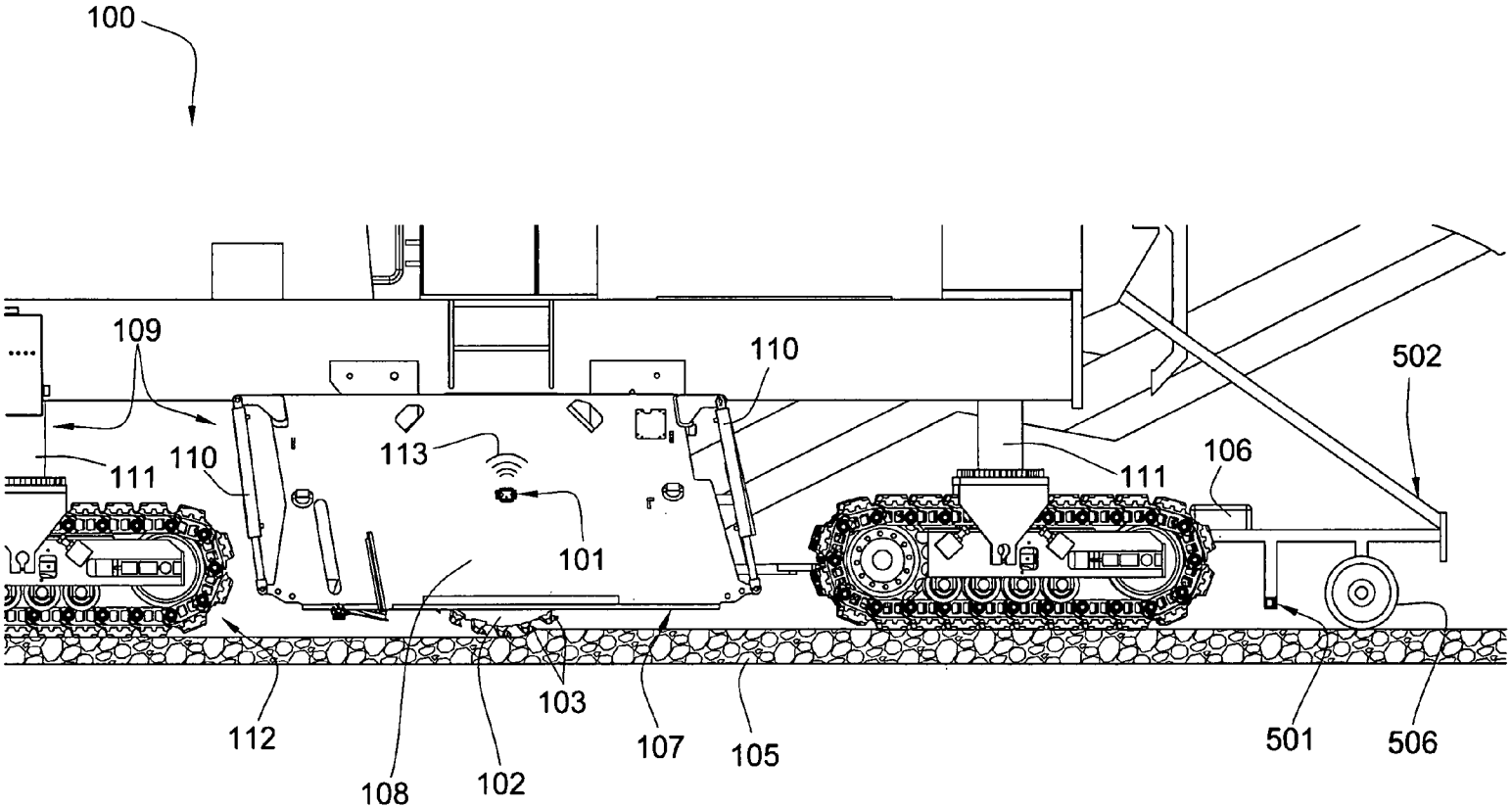
FIG. 1 is an orthogonal diagram of an embodiment of a road milling machine.

FIG. 1 is a cross-sectional diagram of an embodiment of a plurality of a high-impact resistant picks 103 attached to a rotating drum 102 connected to the machine 100 adapted to degrade natural and/or man-made formations. In the embodiment of FIG. 1 the machine 100 is a road milling machine 100. The milling machine 100 may be a cold planer used to degrade man-made formations such as pavement 105 prior to the placement of a new layer of pavement. Picks 103 may be attached to the drum 102 bringing the picks 103 into engagement with the formation 105. A holder or block may hold the pick 103 at an angle offset from the direction of rotation, such that the pick 103 engages the pavement 105 at a preferential angle.

At least one accelerometer 101 is mounted to the machine 100 and is adapted to measure forces acting on the machine 100 in a direction substantially vertical to a direction of travel 201 of the machine 100. The at least one accelerometer 101 may be attached to the outside of a box shield 107 adapted to partially enclose the drum 102. The at least one accelerometer 101 may be attached to a side 108 of the box shield 107 parallel to a direction of travel 201 of the machine 100.

The machine 100 may comprise a mechanism 109 adapted to control, at least in part, a location of the drum 102. The mechanism 109 may comprise a hydraulic piston 111 associated with a translation assembly 112 of the machine 100, or the mechanism may control just the height of the milling chamber. In the embodiment of FIG. 1 the translation assembly 112 may comprise a continuous track 112 disposed intermediate the pavement 105 and the hydraulic piston 111 and is adapted to move the machine 100 along the formation 105. The hydraulic pistons 111 may be adapted to raise the machine 100, including the drum 102, away from the formation 105 and lower the machine 100 along with the drum 102 towards the formation 105. The mechanism 109 may also comprise a lift assembly 110 adapted to control the elevation of the drum 102 with respect to an underside 150 of the machine 100. The lift assembly 110 may comprise hydraulic pistons, mechanical jacks, or combinations thereof. In the embodiment disclosed in FIG. 1, the drum 102 may be disposed in the box shield 107 and the lift assembly 110 may comprise at least one hydraulic piston 110 connected to the underside 150 of the machine 100 and to the box shield 107 and is adapted to control the elevation of the box shield 107 with respect to the underside 150 of the machine 100. The mechanism 109 may be in communication with a power train assembly of the machine 100. The mechanism 109 may also be in communication with a drum driver assembly adapted to alter a rotational speed 202 of the drum 102.

Electronic equipment 106 is in communication with the at least one accelerometer 101 and comprises a processor 401 adapted to determine a change in the formation 105 based off of input from the at least one accelerometer 101. The processor 401 may detect changes in hardness of the formation 105 based off of input from the at least one accelerometer 101. The electronic equipment 106 is also in communication with the mechanism 109 adapted to control, at least in part, a location of the drum 102.

Figure 2A:
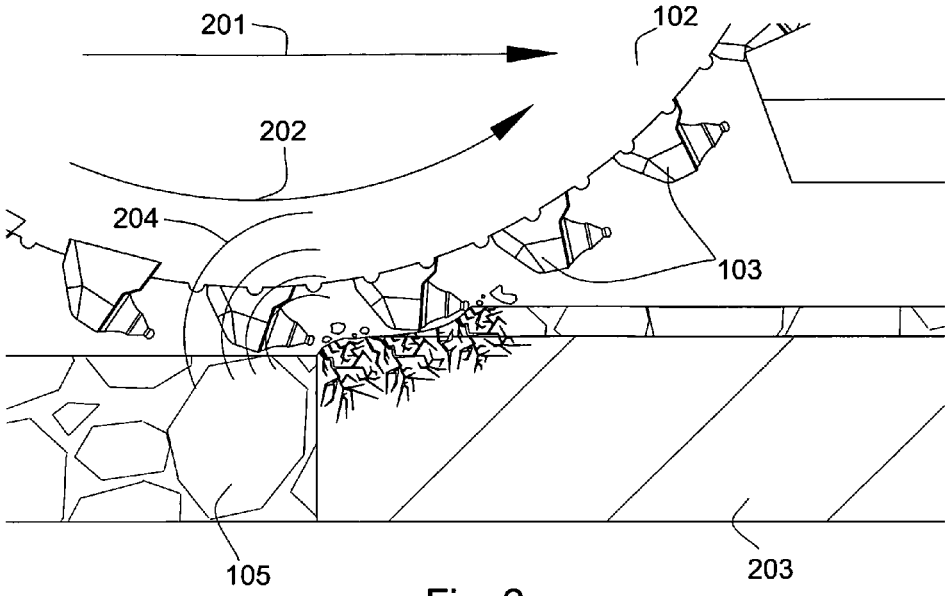
FIG. 2*a* is a cross-sectional diagram of an embodiment of a drum comprising picks.
Figure 2B:
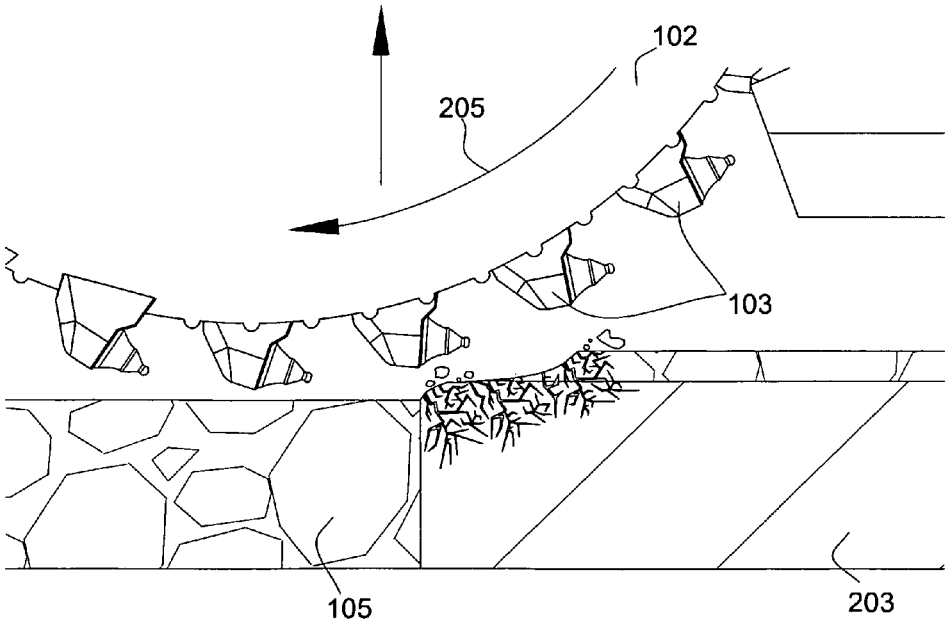
FIG. 2*b* is a cross-sectional diagram of another embodiment of a drum comprising picks.
Figure 2C:
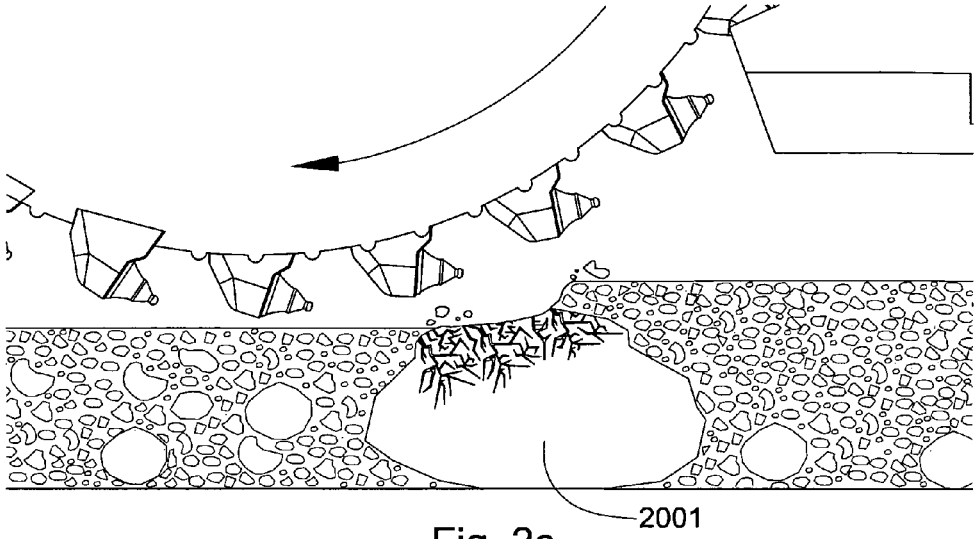
FIG. 2*c* is a cross-sectional diagram of another embodiment of a drum comprising picks.
Figure 2D:
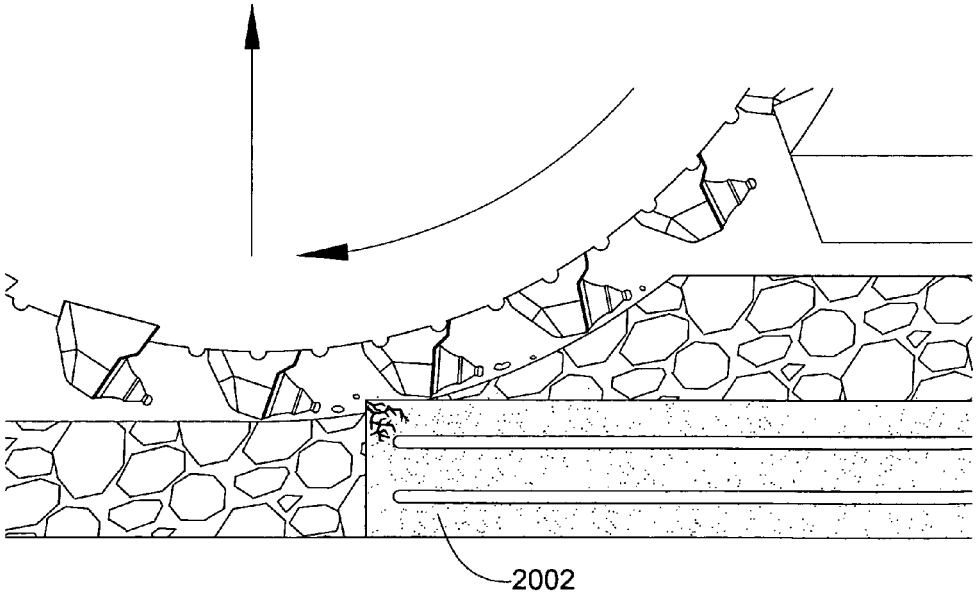
FIG. 2*d* is a cross-sectional diagram of another embodiment of a drum comprising picks.

Referring now to FIGS. 2*a* through 2*d*, the processor 401 may be adapted to detect objects buried in the formation 105 such as a manhole cover 203 covered by pavement 105 based off of input from the at least one accelerometer 101. It is believed that as the picks 103 on the drum 102 degrade the pavement 105 the machine 100 will vibrate at an expected magnitude for a machine 100 degrading pavement 105. It is believed that when the picks 103 contact a hard buried object the magnitude of the vibrations 204 will change. The change of magnitude of the vibrations 204 may be detected by the accelerometer 101 and the accelerometer 101 may send a signal 113 encoding data on the change in magnitude to the processor 401. The processor 401 may be adapted to identify the object by magnitude change and pattern of the vibrations 204 as a manhole cover 203 or other object. The processor may send a command to the mechanism 109 to stop or reverse a direction 201 of the machine 100 and/or drum, adjust a rotational speed 202 and/or rotational direction 205 of the drum 102, and/or adjust a height of the drum 102 with respect to the formation 105. It is believed that by stopping or reversing a direction 201 of the machine 100, adjusting a rotational speed 202 and/or rotational direction 205 of the drum 102, and/or adjusting a height of the drum 102 with respect to the formation 105 that damage on the picks 103, the machine 100, the manhole cover 203, the machine's engine and/or axle, and the buried object will be reduced. FIG. 2*c* discloses the drum engaging a buried rock 2001, and FIG. 2*d* discloses the drum engaging concrete.

Figure 3:
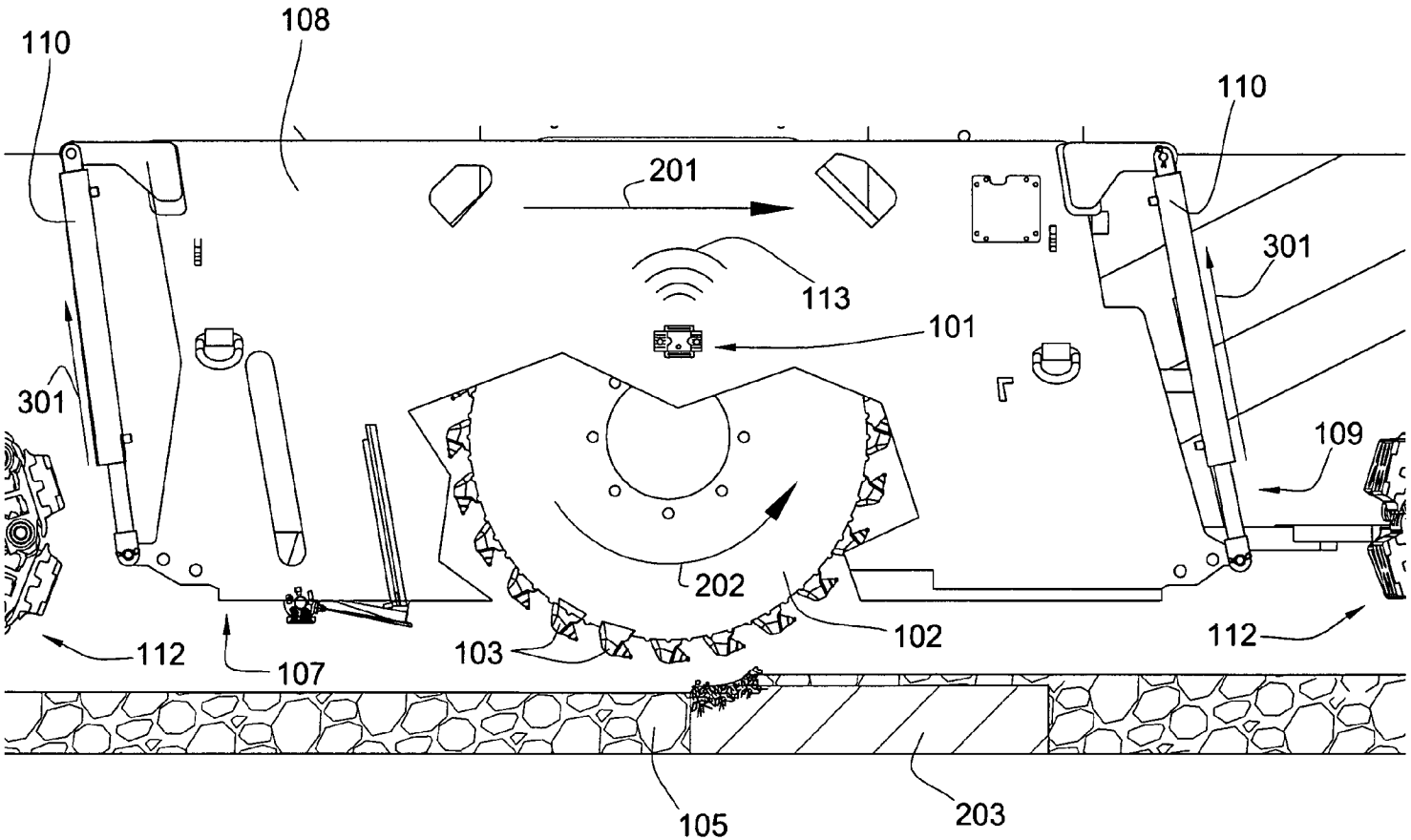
FIG. 3 is a cross-sectional diagram of another embodiment of a road milling machine.

Referring now to FIG. 3, the processor 401 may send a command to the lift assembly 110 to raise 301 the drum 102 away from the formation 105 when a manhole hole 203 or any buried object is detected. The processor 401 may also send a command to the hydraulic piston 111 associated with the translation assembly 112 of the machine 100 to raise the entire of the machine 100 away from the formation 105, as depicted by arrow 301. The at least one accelerometer 101 may send the signal 113 wirelessly to the electronic equipment 106.

Figure 4:
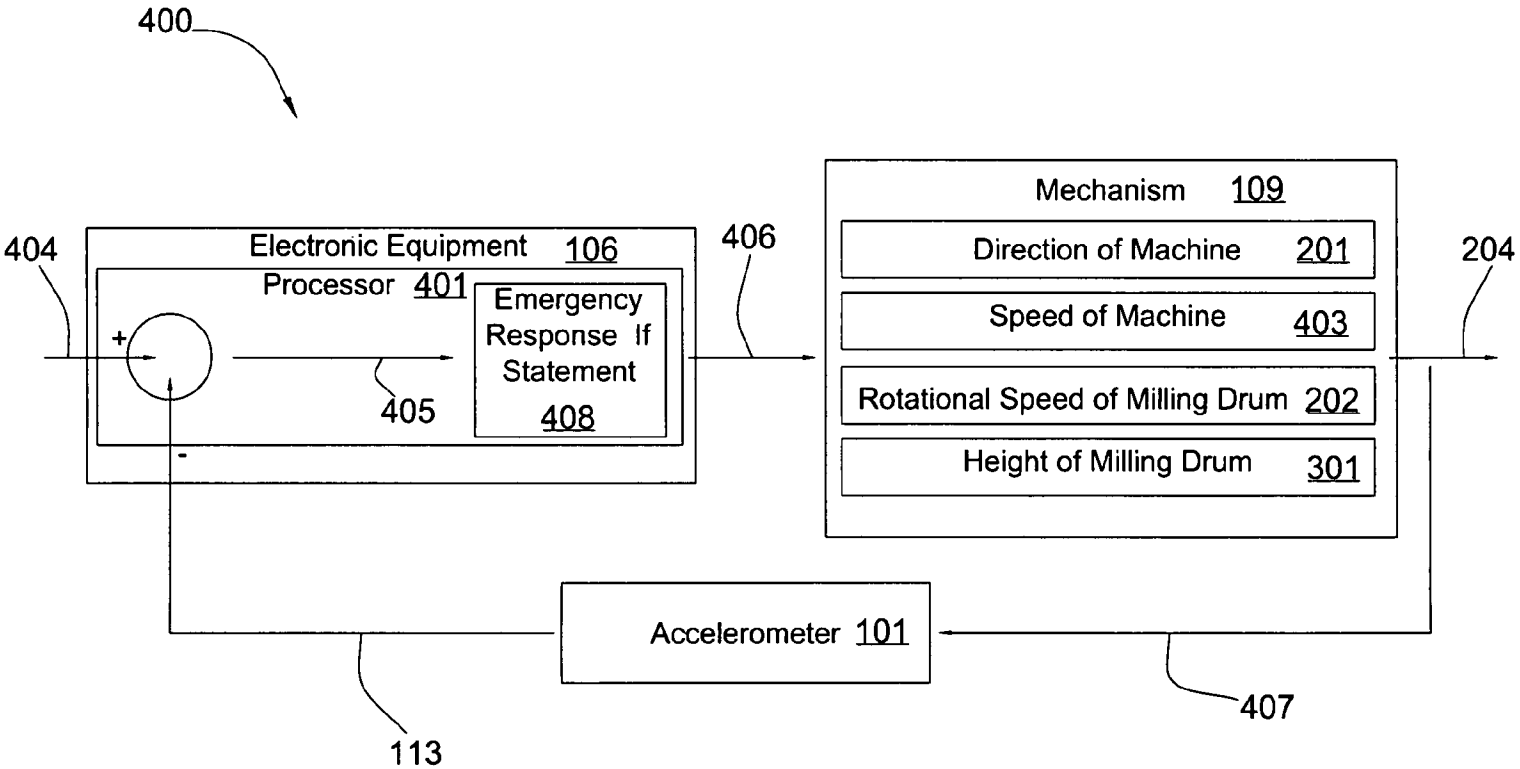
FIG. 4 is a diagram of an embodiment of a feedback loop.

Referring now to FIG. 4, the machine 100 may comprise a negative feedback control loop 400. Input parameters 404 may be fed to the electronic equipment 106 defining the expected magnitude for the vibrations 204 of the machine 100 given the type of formation 105 the machine 100 is degrading. The at least one accelerometer 101 takes a measurement 407 of the magnitude of the vibrations 204 of the machine 100 and may send a signal 113 containing the measurements 407 of the vibrations 204 to the electronic equipment 106. The signal 113 may be a negative feedback signal 113. The processor 401 may compare the measurements 407 of the vibrations 204 in the negative feedback signal 113 with the input parameters 404 and determine an error 405 between the measurements 407 in the negative feedback signal 113 and the input parameters 404. The processor 401 may run the error 405 through an emergency response "IF statement" 408. The emergency response "IF statement" 408 may comprise an emergency threshold. If the error 405 is below the emergency threshold the processor 106 may send a command 406 to the mechanism 109 to adjust the direction 201 of the machine 100, a directional speed 403 of the machine 100, adjust the rotational speed 202 and/or rotational direction 205 of the drum 102, and/or adjust a height of the drum 102 with respect to the formation 105 such that the error 405 between the measurements 407 in the negative feedback signal 113 and the input parameters 404 is minimized. If the error 405 exceeds the emergency threshold of the emergency response "IF statement" 408, the processor 401 may send a command 406 to the mechanism 109 to stop the milling of the formation 105 by the machine 100 raise the drum, slow down the drum, and/or combinations thereof.

Figure 5:
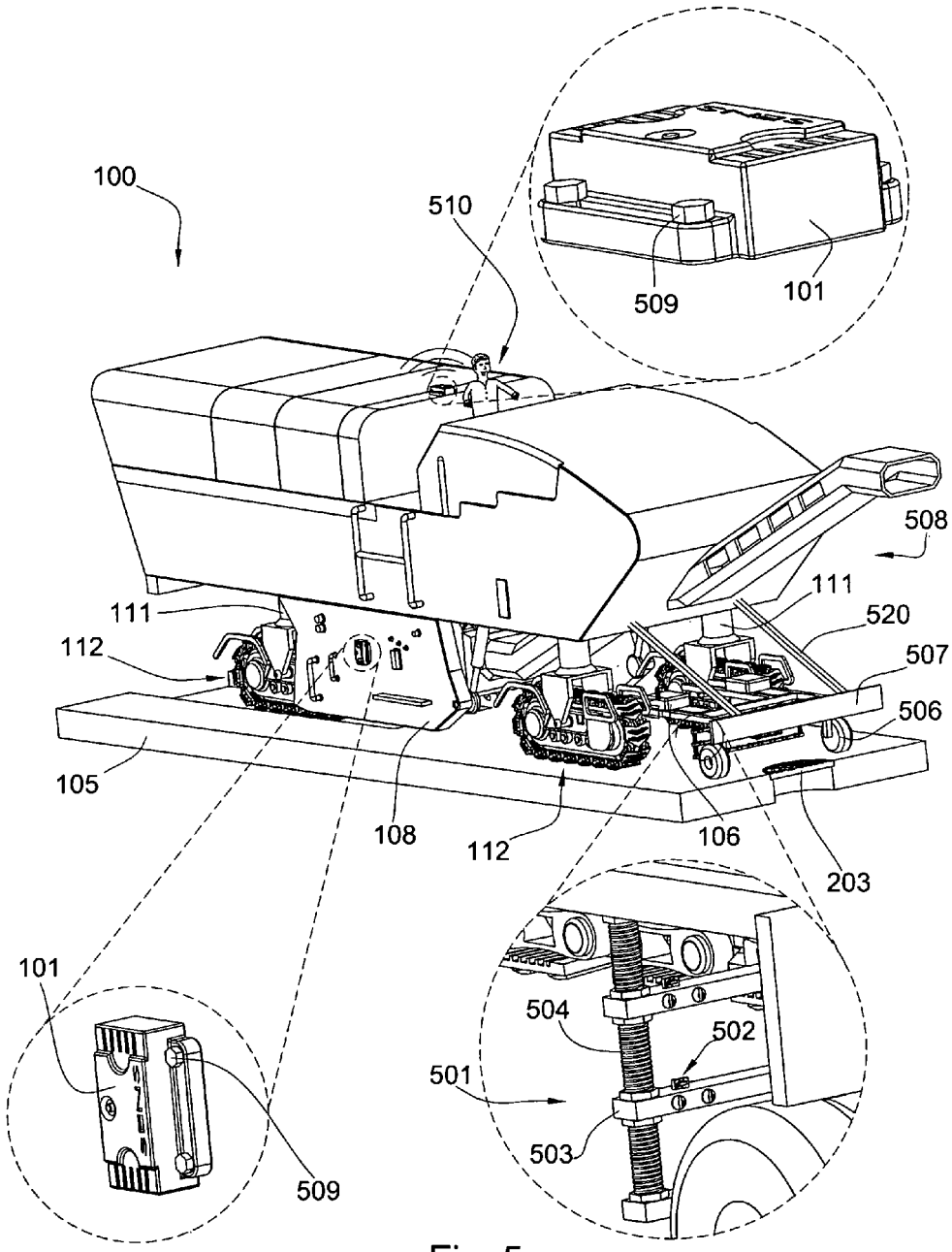
FIG. 5 is a perspective diagram of another embodiment of a road milling machine.

Referring now to FIG. 5, the at least one accelerometer 101 may detect acceleration on three axes. The at least one accelerometer 101 can measure acceleration from 0 G to 10 G and the at least one accelerometer 101 may have a resolution of 0.001 G. The at least one accelerometer 101 may be a GP1 Programmable Accelerometer. The at least one accelerometer 101 may be attached to the machine 100 via a connecting mechanism 509. The connecting mechanism 509 may comprise but is not limited to a bolt 509, a nut, a lug, a screw, an adhesive, or combinations thereof. At least one accelerometer may be disposed on a top 510 of the machine 100 and proximate the operator and may measure the magnitude of the vibrations 204 as experienced by the operator. The electronic equipment 106 may be in communication with a fuel consumption sensor adapted to measure the real time fuel consumption of the machine 100 during operation.

In some embodiments, the accelerometers have a high enough resolution to identify every time a pick engages the pavement. In some embodiments, the milling drum is design so that only one pick engages the pavement at a time allowing the processing element to identify which pick correlates to which measurement. Such data allows the processing element to identify where along the swath of the milling drum a buried object may be. It will also allow for the processing element to identify that a pick is missing, damaged, dull, worn, fractured, loose, improperly working, or combinations thereof.

The electronic equipment 106 may be in communication with a metal detector 501 attached to a front end 508 of the machine 100. The metal detector 501 comprises a plurality of magnetometers 502 mounted substantially vertically with respect to one another on a frame 520 disposed at the front end 508 of the machine 100. The frame 520 may comprise a rack 504 that has at least one horizontal cross beam 503. The plurality of magnetometers 502 may be mounted vertically to the at least one horizontal cross beam 503. In the embodiment of FIG. 5, the rack 504 may comprise three horizontal cross beams 503 spaced vertically along the rack 504. The three horizontal cross beams 503 each comprise at least one magnetometer 502 mounted in a substantially vertical pattern It is believed that by having at least one magnetometer 502 mounted vertically with respect to another, the depth and dimensions of the buried metallic objects may be determined. The frame 520, the rack 504, and the at least one cross beam 503 may be made from a nonmetallic material. The frame 520 may comprise a protective bumper 507 and the protective bumper 507 may also be made from a nonmetallic material. The fame 520 may be supported by at least one wheel 506 adapted to engage the pavement. The electronic equipment 106 may be in communication with the plurality of magnetometers 502 and the processor 401 may be adapted to determine a change in the formation 501 based off of input from the plurality of magnetometers 502. The electronic equipment 106 may send a command to the mechanism 109 to alter a location of the drum 102 in response to the input from the plurality of magnetometers 502 to the processor 401.

In some embodiments, the magnetometers are located directly over each other; and in other embodiments, the magnetometers are offset horizontally. The cross beams may be vertically, horizontally, or pivotally adjustable. In some embodiments, the strength of the magnetometers is electrically adjustable. The magnetometers may be focused towards the pavement through a magnetically focusing material.

Figure 6:
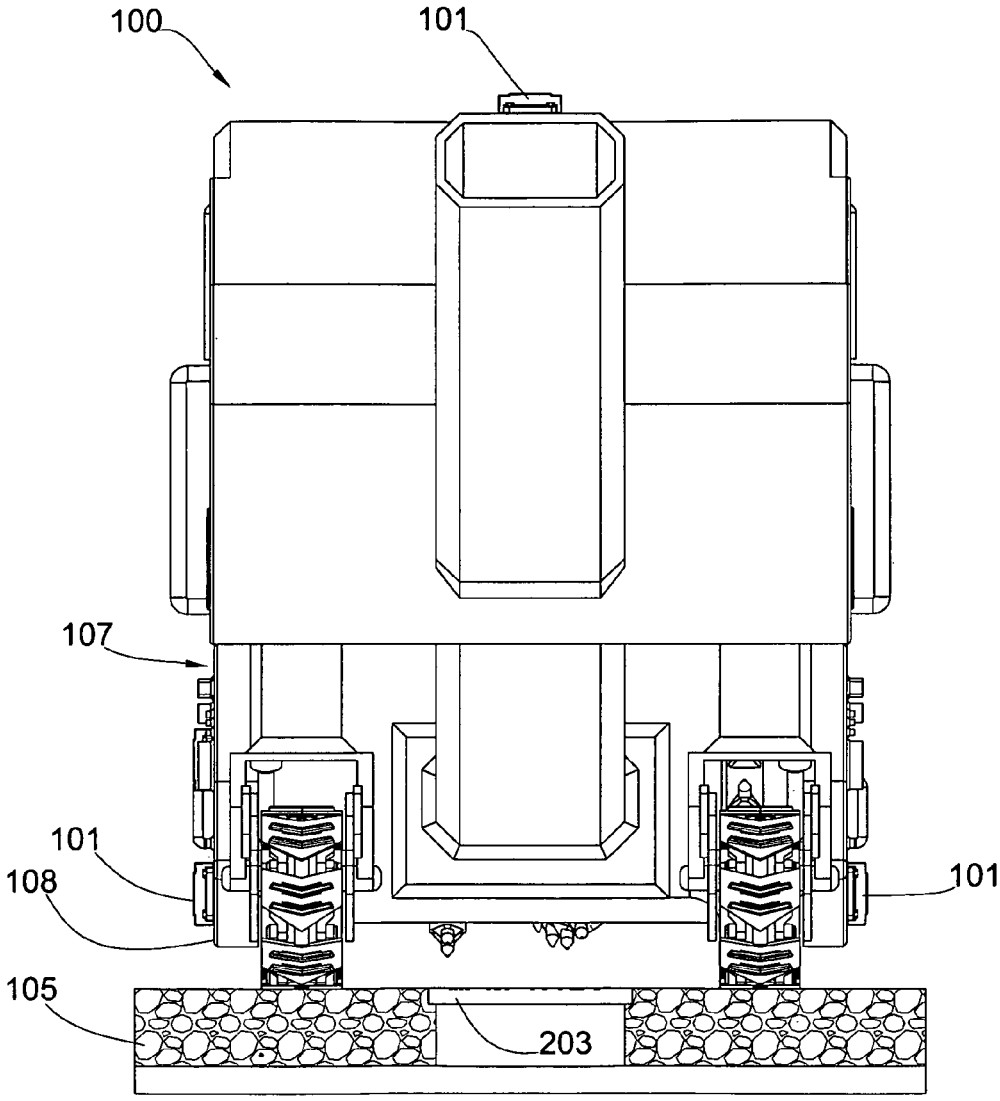
FIG. 6 is an orthogonal diagram of another embodiment of a road milling machine.

Referring now to FIG. 6, at least three accelerometers 101 may be mounted to the machine 100 and may be adapted to assist the electronic equipment 106 in finding the location of objects buried in the formation 105, such as manhole covers 203, through triangulation. The at least three accelerometers 101 may be mounted to the top 510 of the machine 100, to the sides of the machine 100, to the underside of the machine 100, or combinations thereof.

Figure 7:
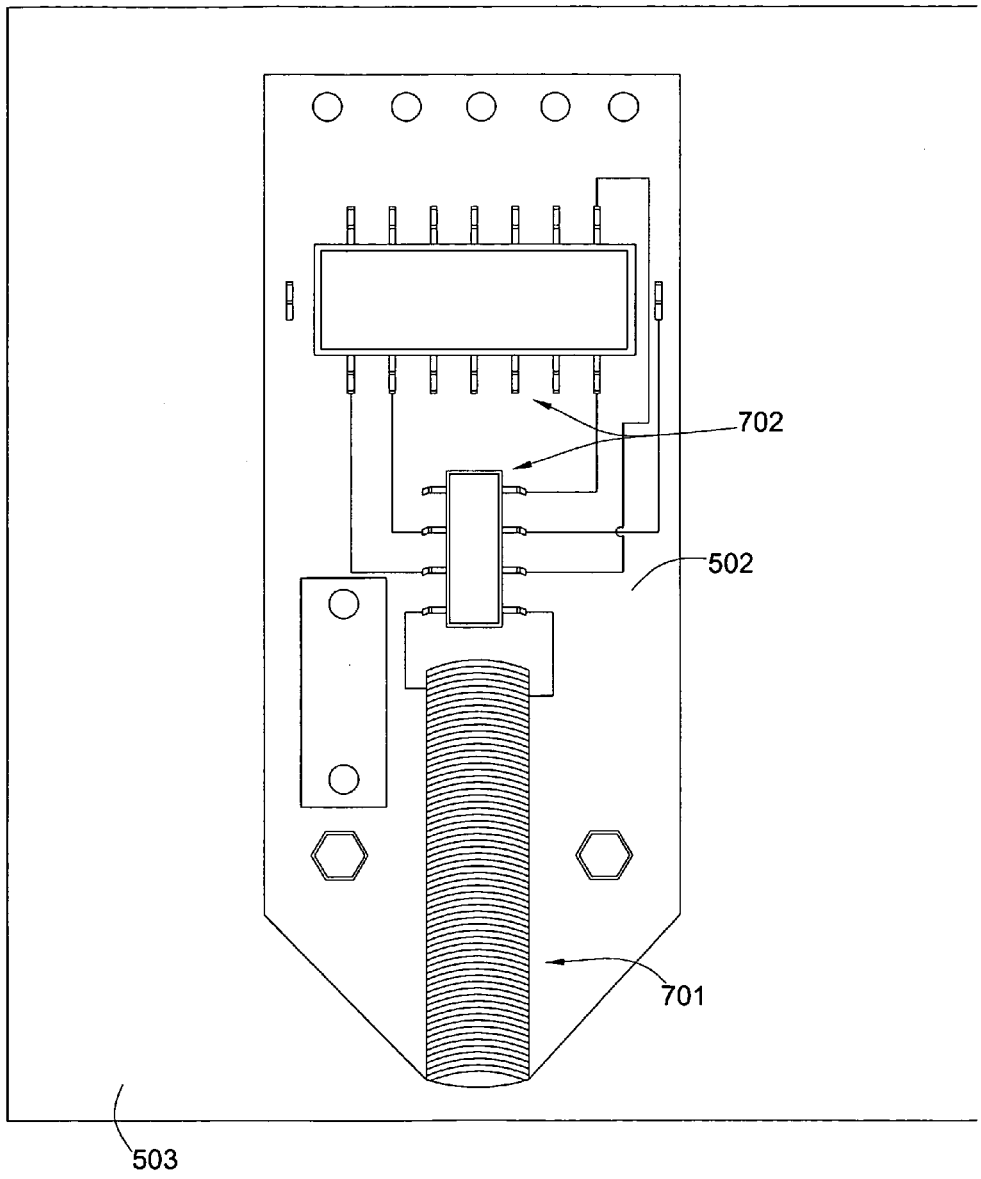
FIG. 7 is an orthogonal diagram of an embodiment of a magnetometer.

FIG. 7 discloses an embodiment of a magnetometer 502 mounted to a horizontal cross beam 503. The magnetometer 502 may comprise at least one metallic coil 701 with supporting circuitry 702. The magnetometer 502 may comprise two metallic coils 701. The plurality of magnetometers 502 may comprise the Miniature Fluxgate Magnetic Field Sensor FLC 100 developed by Stefan Mayer Instruments. The plurality of magnetometers 502 are mounted to the horizontal cross beam 503 such that the metallic coil 701 is in a substantially vertical position.

Figure 8:
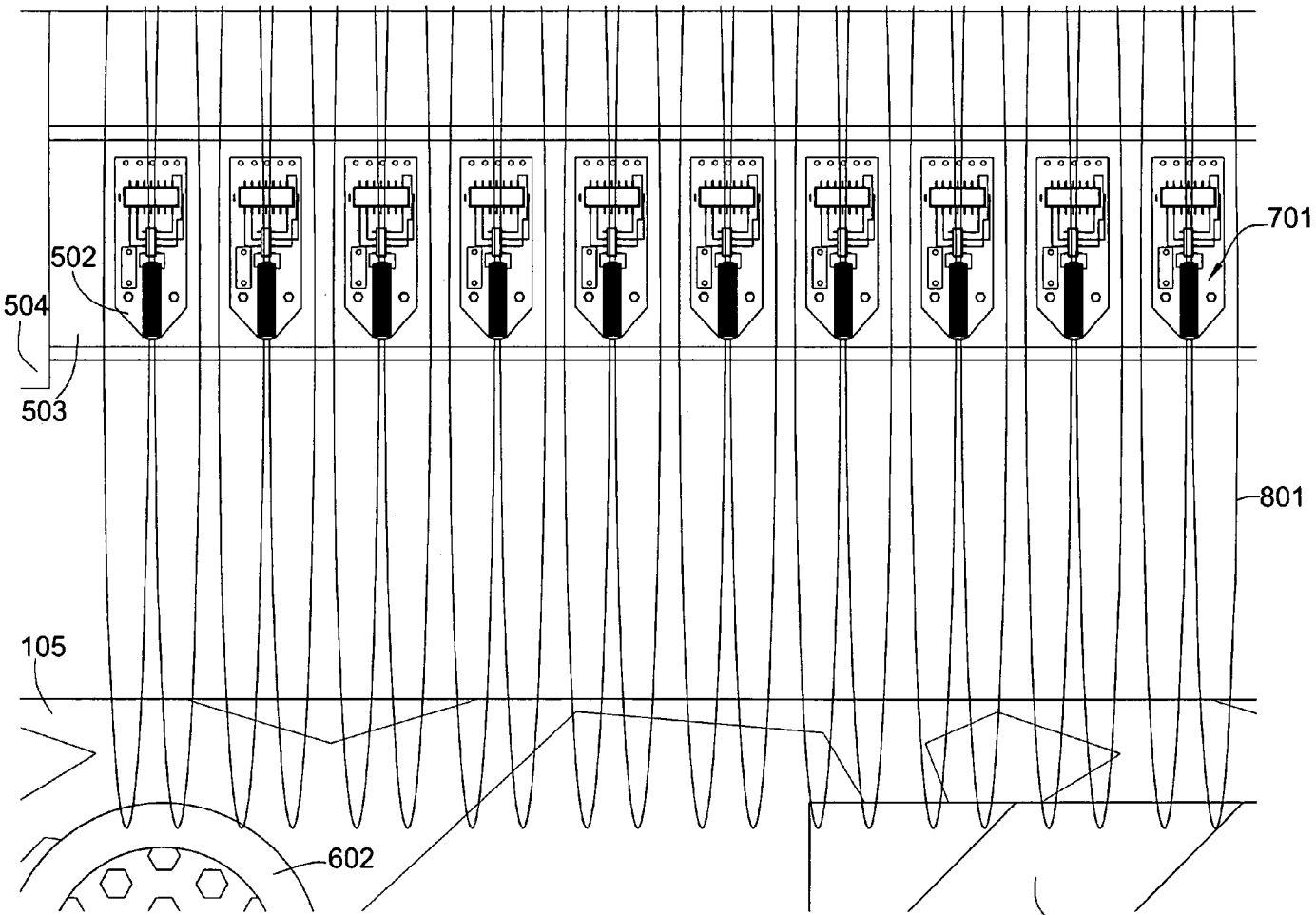
FIG. 8 is a cross-sectional diagram of an embodiment of a plurality of magnetometers.

Referring now to FIG. 8, the plurality of magnetometers 502 may be spaced along the at least one horizontal cross beam 503 such that the magnetic field of each magnetometer 502, represented by magnetic field lines 801 extending from the at least one metallic coils 701 of each magnetometer 502, does not interfere with the magnetic fields of the other magnetometers 502 mounted on the at least one horizontal cross beam 503. A detection range of the plurality of magnetometers 502 may be controlled by a variable voltage source. The detection range of the magnetometers 502 may have a minimum range of at least 12 inches into the formation 105. The magnetometers 502 may be used to detect manhole covers 203, utility lines 802, and other objects buried in the formation 105.

Figure 9:
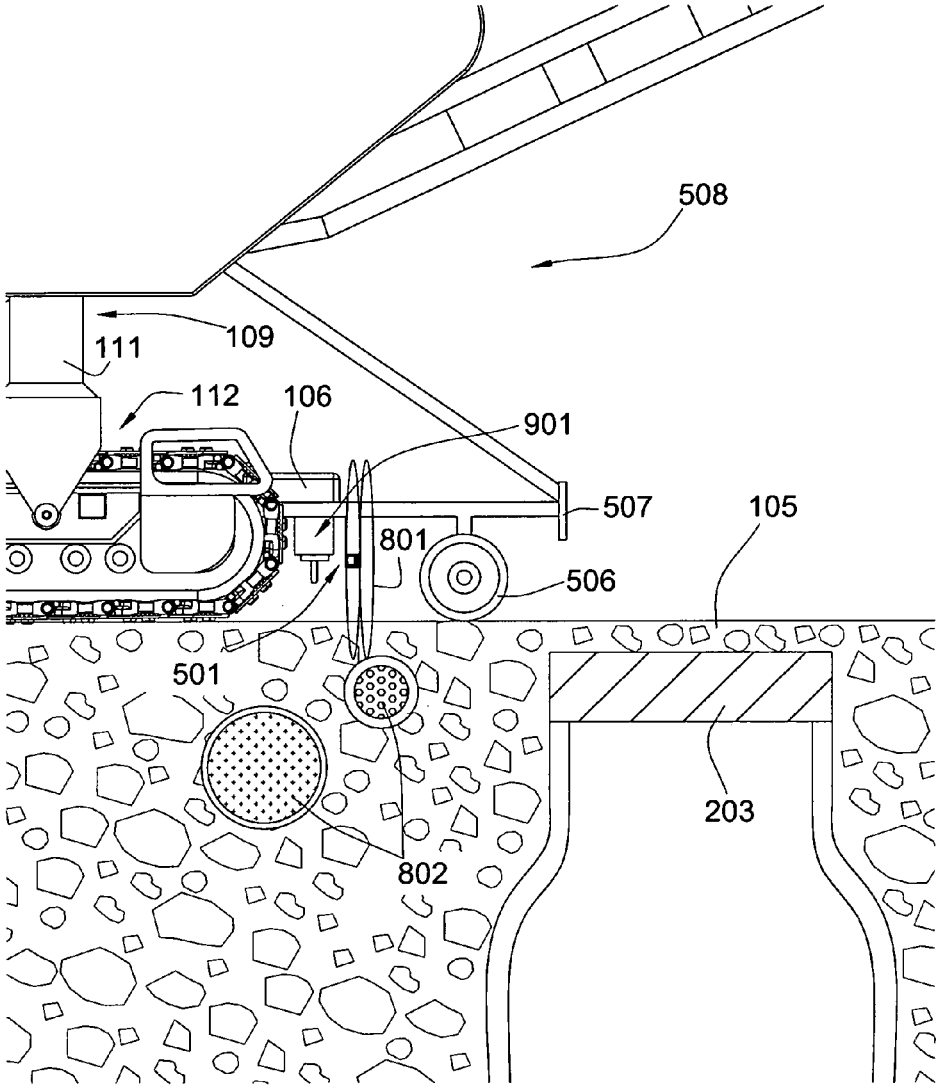
FIG. 9 is an orthogonal diagram of another embodiment of a road milling machine.

FIG. 9 discloses an embodiment of the invention wherein a marking assembly 901 may be mounted to the front end 508 of the machine 100 intermediate the metal detector 501 and the drum 102. The marking assembly 901 may be in communication with the electronic equipment 106 and may be adapted to receive commands from the processor 401 to visibly mark the location of an object buried in the formation 105. The marking assembly 901 may mark the location of an object buried in the formation 105 by applying paint to the surface of the formation 105.

Figure 10:
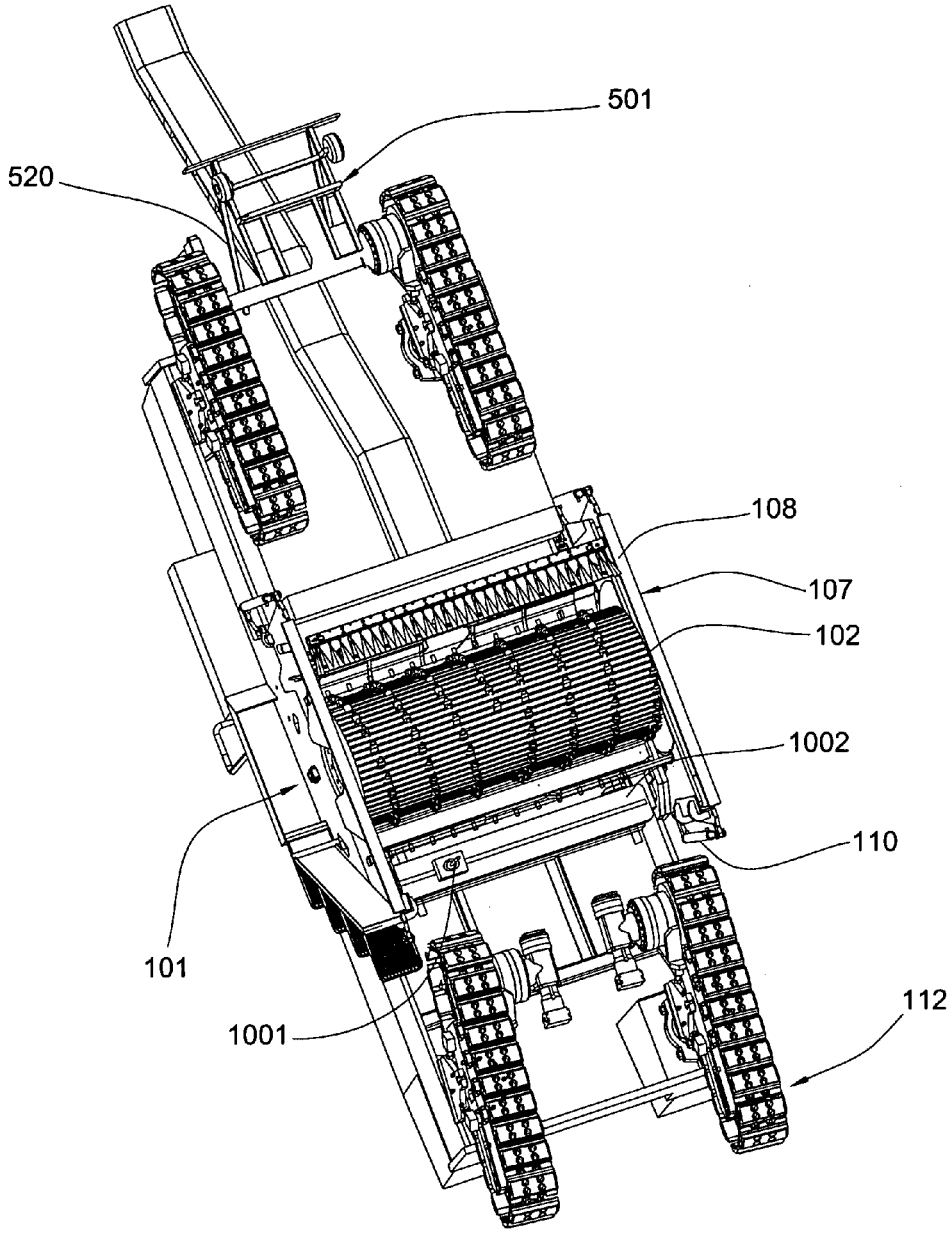
FIG. 10 is a perspective diagram of another embodiment of a road milling machine.

Referring now to FIG. 10, the drum 102 may be disposed intermediate the metal detector 501 and the marking assembly 901. The marking assembly 901 may comprise a paint dispenser 1001 adapted to move a long a horizontal track 1002 connected to the underside of the machine 100.

Figure 11:
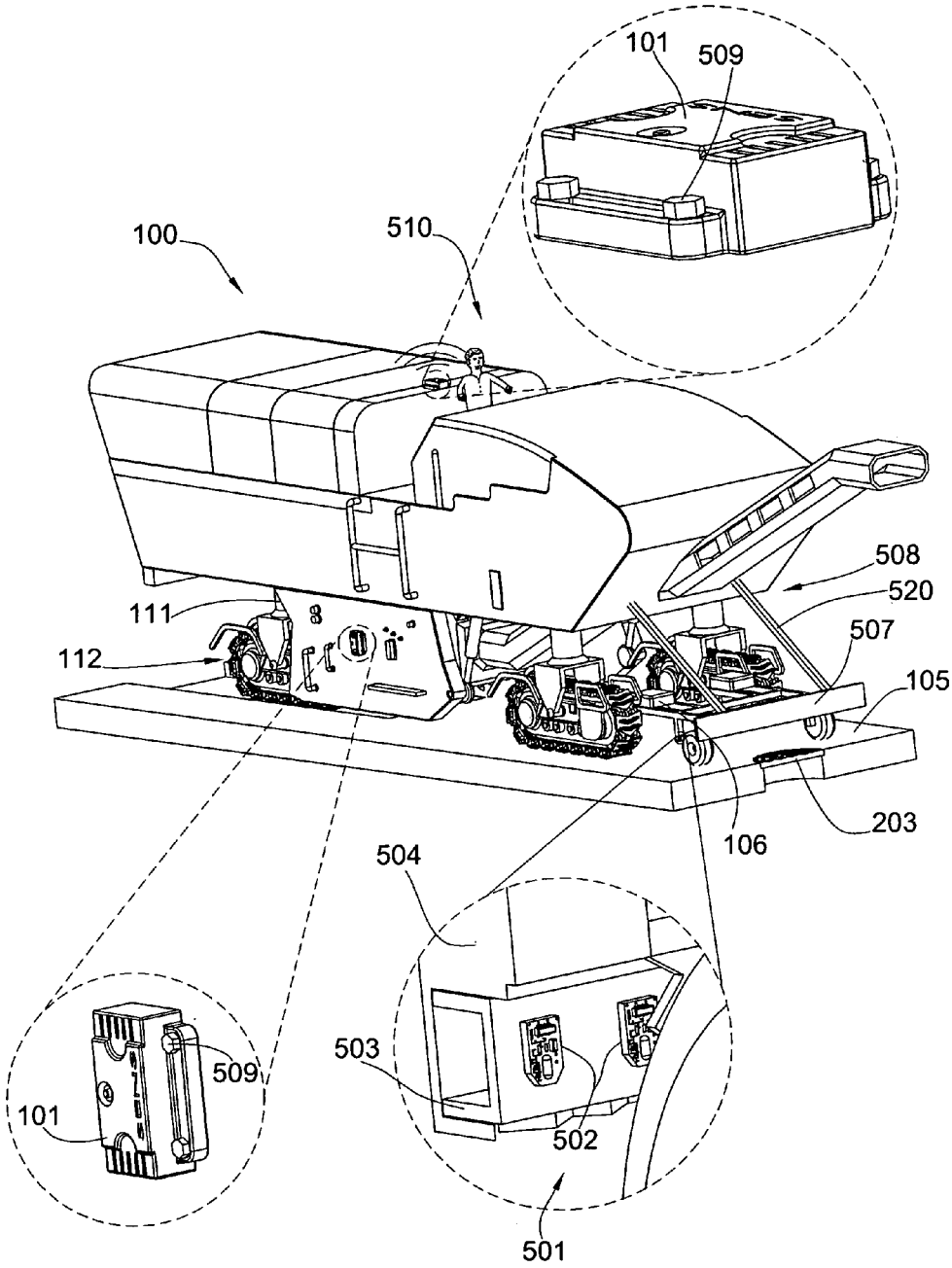
FIG. 11 is a perspective diagram of another embodiment of a road milling machine.

Referring now to FIG. 11, the machine 100 may comprise at least one sensor mounted to the machine adapted to measure adverse conditions on the machine. The sensor may comprise at least one accelerometer 101, a plurality of magnetometers 502, or combinations thereof. Electronic equipment 106 may be in communication with the at least one sensor, the electronic equipment 106 being adapted to determine a change in the formation 105 from feedback from the at least one sensor. The electronic equipment 106 may be adapted to execute an emergency response based off the feedback. The emergency response may include cutting power on the machine, disengaging the picks 103 on the drum 103 from the formation 105, or combinations thereof.

Figure 12:
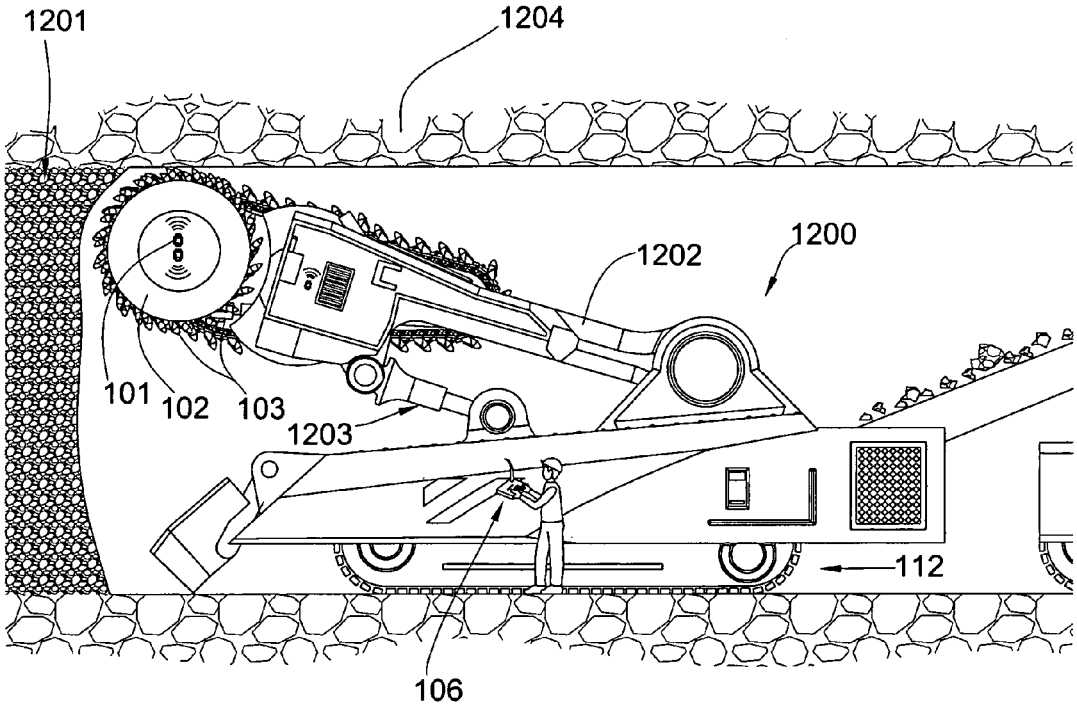
FIG. 12 is a perspective diagram of an embodiment of a mining machine.

FIG. 12 discloses an embodiment wherein the machine 100 may be a mining machine 1200. Picks 103 are connected to a rotating drum 102 that is degrading coal 1201. The rotating drum 102 is connected to an arm 1202 that moves the drum 102 vertically in order to engage the coal 1201. The arm 1202 may move by a hydraulic arm 1203, it may also pivot about an axis or a combination thereof The mining machine 1200 may move about by tracks 112, wheels, or a combination thereof. The mining machine 1200 may also move about in a subterranean formation. The at least one accelerometer 101 may be attached to the drum 102. The electronic equipment 106 may be handheld and may communicate with the at least one accelerometer 101 wirelessly. The at least one accelerometer 101 and the electronic equipment 106 together may be able to detect if the picks 103 are contacting a target formation, such as coal 1201, or if the picks 103 are contacting an off-target formation 1204.

Figure 13:
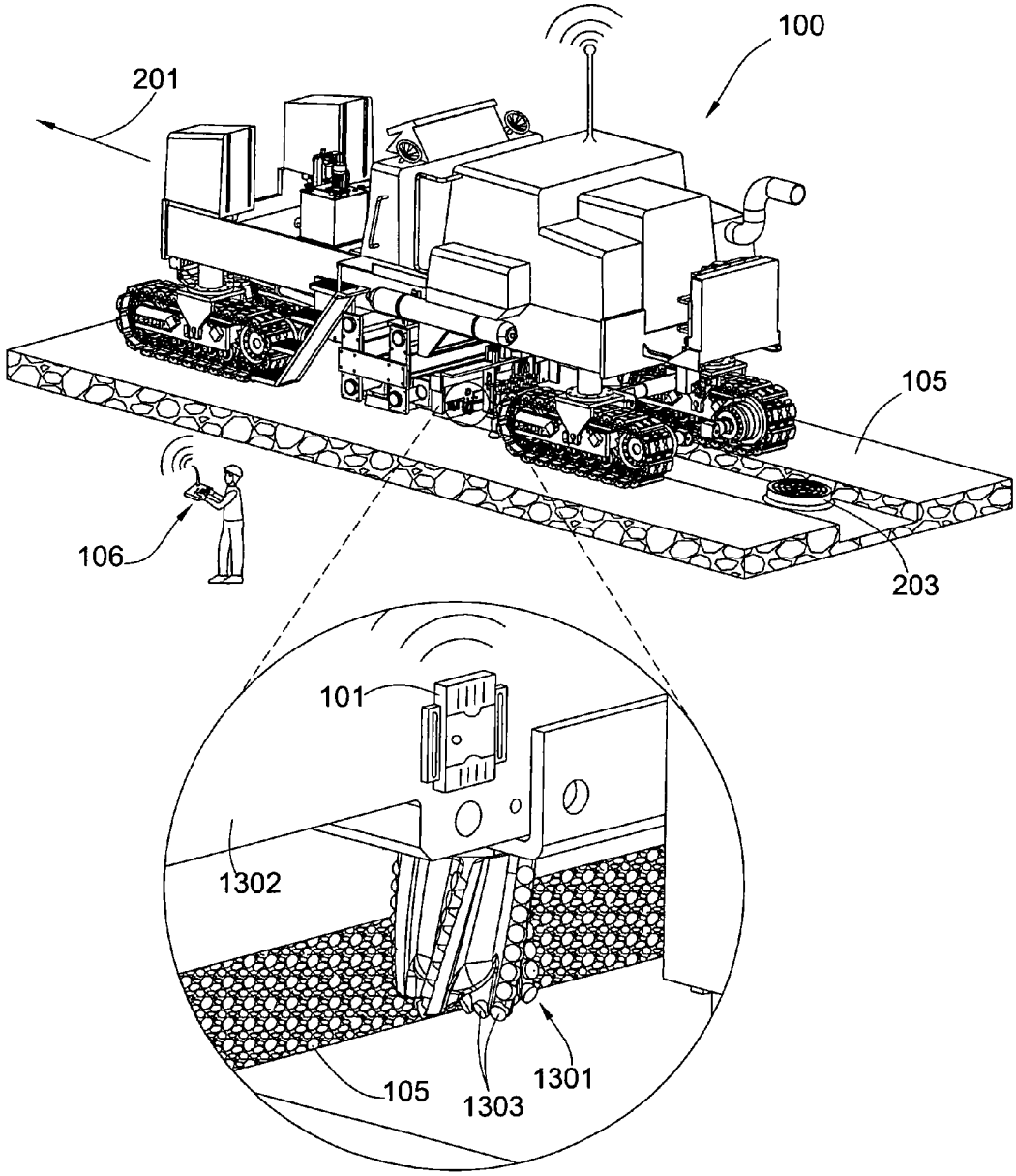
FIG. 13 is a perspective diagram of another embodiment of a road milling machine.

Referring now to FIG. 13, the machine 100 may comprise a vertically aligned rotary element 1301 comprising an array of super hard cutters 1303 adapted to rotate about a vertical central axis of the vertically aligned rotary element 1301. The at least one accelerometer 101 may be mounted a support 1302 adapted to support and carry the vertically aligned rotary element 1301. A vertically aligned rotary element that may be compatible with the present invention is disclosed in U.S. patent application Ser. No. 11/162,429 to Hall and is currently pending.

Figure 14:
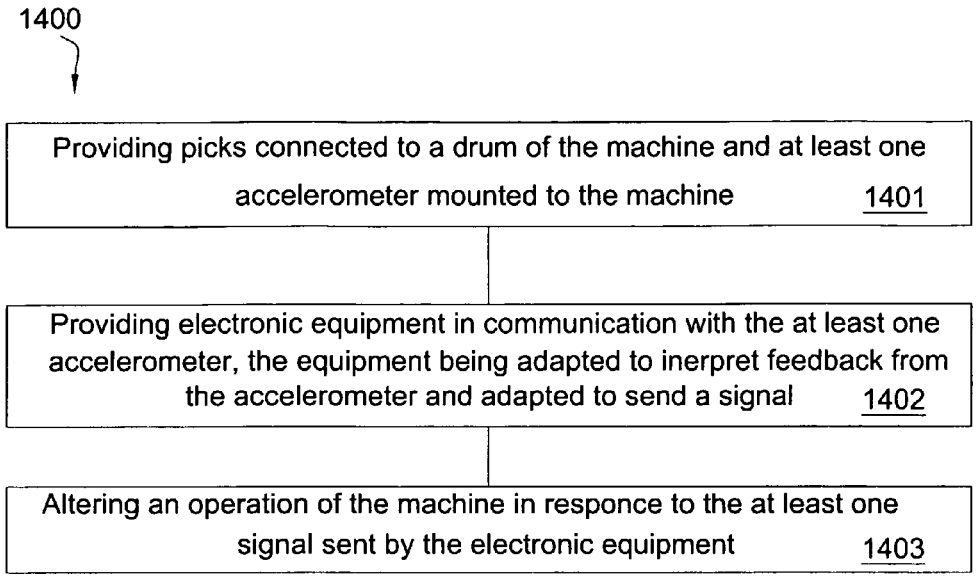
FIG. 14 is a method of an embodiment for reducing wear on a machine for degrading natural and/or man-made formations.

FIG. 14 discloses a method 1400 for reducing wear on a machine for degrading a natural and/or man-made formation. The method 1400 may comprise the steps of providing 1401 picks connected to a drum of the machine and at least one accelerometer mounted to the machine; providing 1402 electronic equipment in communication with the at least one accelerometer, the equipment being adapted to interpret feedback from the accelerometer and adapted to send a signal; and altering 1403 an operation of the machine in response to the at least one signal sent by the electronic equipment.

Whereas the present invention has been described in particular relation to the drawings attached hereto, it should be understood that other and further modifications apart from those shown or suggested herein, may be made within the scope and spirit of the present invention.

What is claimed is:

1. A machine for degrading a natural and/or man-made formation, comprising:

picks connected to a drum of the machine and at least one accelerometer mounted to the machine adapted to measure forces acting on the machine in a direction substantially vertical to a direction of travel of the machine;

electronic equipment in communication with the at least one accelerometer, the electronic equipment comprising a processor adapted to determine a change in the formation based off of input of the forces from the vertical direction from the at least one accelerometer; and the at least one accelerometer has enough resolution to identify a location along the swath of the drum of a buried object.

2. The machine of claim 1, wherein the electronic equipment also being in communication with a mechanism adapted to control, at least in part, a location of the drum in response to the input from the at least one accelerometer.

3. The machine of claim 2, wherein the mechanism comprises a lift assembly adapted to control the elevation of the drum with respect to an underside of the machine.

4. The machine of claim 3, wherein the lift assembly comprises hydraulic pistons, mechanical jacks or combinations thereof.

5. The machine of claim 2, wherein the mechanism is in communication with a power train assembly of the machine.

6. The machine of claim 2, wherein the mechanism is in communication with a drum driver assembly adapted to alter a rotational speed of the drum.

7. The machine of claim 2, wherein the at least one accelerometer communicates wirelessly with the electronic equipment.

8. The machine of claim 1, wherein the at least one accelerometer detects acceleration on three axes.

9. The machine of claim 1, wherein the at least one accelerometer can measure acceleration from 0 G to 10 G.

10. The machine of claim 1, wherein the at least one accelerometer has a resolution of 0.001 G.

11. The machine of claim 1, wherein the electronic equipment is in communication with a fuel consumption sensor adapted to measure the real time fuel consumption of the machine during operation.

12. The machine of claim 1, wherein the electronic equipment is in communication with a metal detector attached to a front end of the machine.

13. The machine of claim 10, wherein a detection range of the metal detector is controlled by a variable voltage source.

14. The machine of claim 1, wherein the machine is a road milling machine.

15. The machine of claim 1, wherein the machine is a mining machine.

16. The machine of claim 1, wherein the machine comprises a vertically aligned rotary element comprising an array of super hard cutters adapted to rotate about a vertical central axis.

17. The machine of claim 1, wherein the at least one accelerometer is attached to the drum.

18. The machine of claim 1, wherein the at least one accelerometer is attached to a box shield adapted to partially enclose the drum and proximate a bearing housing for the drum.

* * * * *